United States Patent [19]

Haverland

[11] 4,106,719

[45] Aug. 15, 1978

[54] REEL ASSEMBLY FOR KITE LINES AND THE LIKE

[76] Inventor: Joseph G. Haverland, 516 Tallow Ct., Chula Vista, Calif. 92011

[21] Appl. No.: 785,387

[22] Filed: Apr. 7, 1977

[51] Int. Cl.[2] ..... B65H 75/30; B65H 75/40

[52] U.S. Cl. ..... 242/96; 242/84.5 R; 242/99; 242/156

[58] Field of Search ..... 242/96, 99, 84.8, 84.5 R, 242/84.51 R, 156, 156.2, 107.3

[56] References Cited

U.S. PATENT DOCUMENTS

| | | | |
|---|---|---|---|
| 254,881 | 3/1882 | McClure | 242/99 |
| 874,130 | 12/1907 | Stanley | 242/96 |
| 1,199,790 | 10/1916 | Holcomb | 242/96 |
| 1,301,189 | 4/1919 | Steen | 242/96 |
| 3,423,044 | 1/1969 | Beiderwell | 242/96 |
| 3,473,754 | 10/1969 | Quenot | 242/84.8 |
| 3,731,887 | 5/1973 | Wheeler | 242/96 |
| 3,806,059 | 4/1974 | Quenot | 242/84.8 |
| 3,908,277 | 9/1975 | Rutty | 242/84.8 X |

*Primary Examiner*—Harvey C. Hornsby
*Assistant Examiner*—John M. Jillions
*Attorney, Agent, or Firm*—Tom Sherrard

[57] ABSTRACT

A reel assembly having fixed parts that are pressed together and including a moving spool within and a crank at one side and a brake unit at the other side of the fixed parts.

3 Claims, 10 Drawing Figures

REEL ASSEMBLY FOR KITE LINES AND THE LIKE

BACKGROUND OF THE INVENTION

Kites are flying higher than ever. Revolutionary new designs and materials have produced spectacular kites, including a 45 foot long Mylar dragon and huge parafoils. Until my invention, line retrievers have not kept pace with kites and the fact that many persons having all degrees of skills and resources now fly those kites. Until now a truly universal winder has not existed. With many, gloves are required to avoid line burns, especially when children use hard pullers. Precision devices are too expensive for many people and resort to skeiner non-reel retrievers demonstrates that the conventional rotor type winders have short-comings.

SUMMARY

My invention minimizes production costs by having two opposing body sections that are designed for fabrication in a plastic mold. Their configuration accepts a centrally located spool and the matching body portions have aligning pins and recess for exact abutment and cementing together with the spool operatively mounted between them. Integral therewith is a handle for manuevering the kite. A crank with handle is integral with the spool and, at the opposite end of the spool axis, a unique adjustable brake provides sensitive drag control for the kite flyer.

DESCRIPTION OF PREFERRED EMBODIMENT

Figure 1:
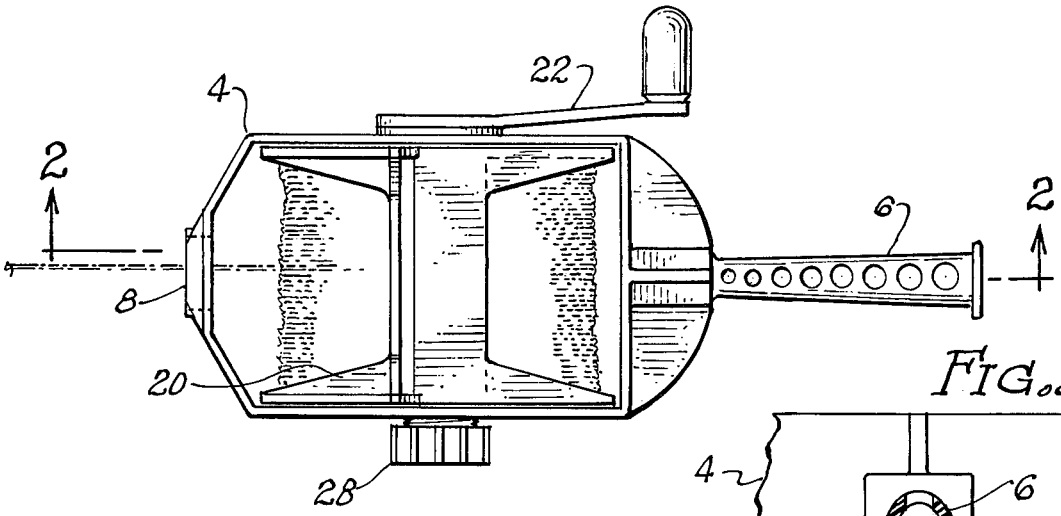
FIG. 1 is a top plan view of my invention.

In the accompanying drawings wherein like reference numbers represent like parts throughout the numeral 4 is a substantially rectangular upper body member. An upper surface is slightly arcuate at one end and the opposite surface is flat with a plurality of bosses 12. Item 4 is preferably hollowed out and has two like semicircular recesses 10 centrally along each side. At the arcuate end, I have provided a substantially rectangular aperture 8 and at the opposite end I have provided an additional protrusion 16 of greater dimensions than the bosses for added strength and alignment. It is preferably of illustrated configuration. The exterior portion is substantially a flat space for printed indicia. Integral therewith and depending from the described parts is a substantially hollow semi-elipsoid shaped member 6, preferably provided with a plurality of orifices along and through its walls.

Figure 6:
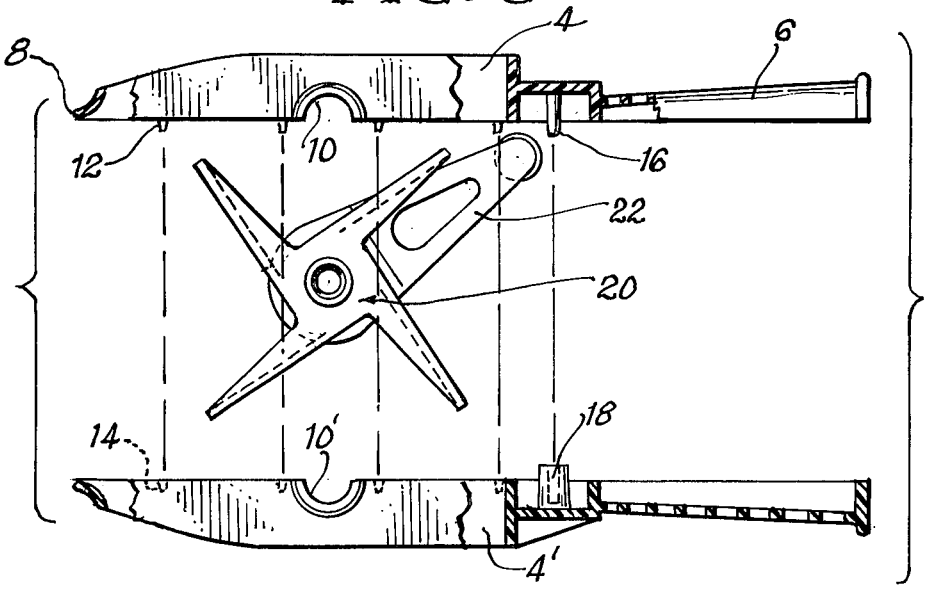
FIG. 6 is an exploded view of the invention from the side thereof.
Figure 7:
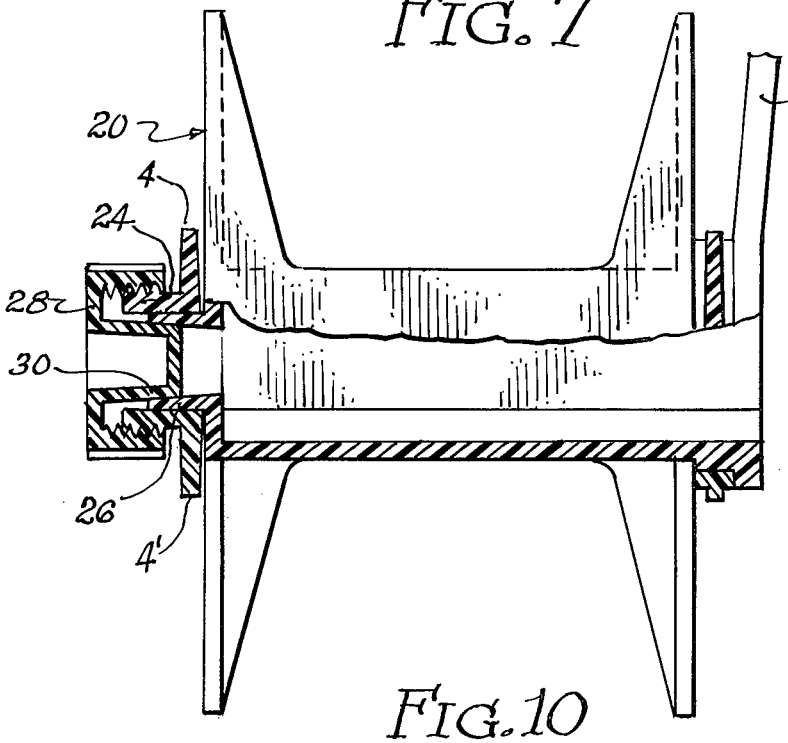
FIG. 7 is an end view of the spool and a cross sectional view of the brake assembly.
Figure 8:
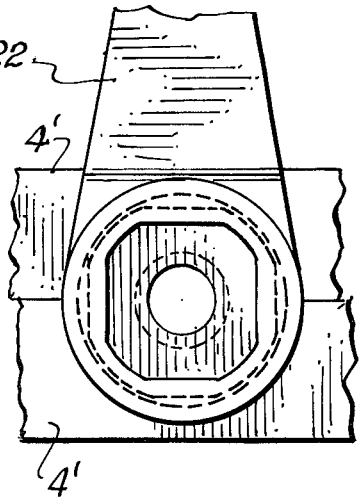
FIG. 8 is a fragmentary view of the end of the spool and body portions taken from the side having the crank.
Figure 9:
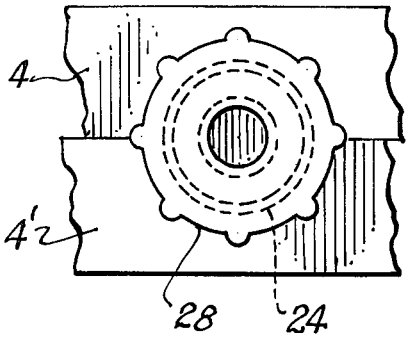
FIG. 9 is the same as that of FIG. 8 but taken from the opposite, i.e. the brake side.
Figure 10:
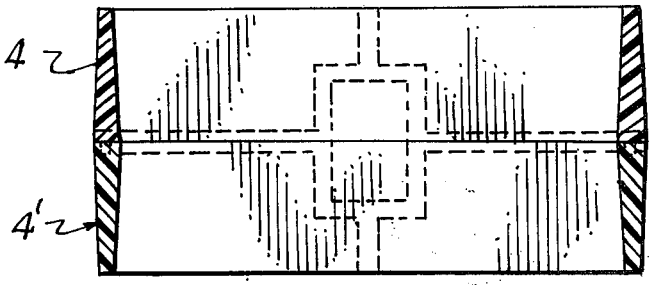
FIG. 10 is a cross sectional view taken along line 10—10 of FIG. 2 from direction of arrow.

For cementing therewith, I have provided like counter parts indicated as lower body member 4', except that instead of bosses and extended protrusions, I have provided a plurality of recesses 14 to receive the bosses 12. Adjacent thereto is protrustion receptable 18 to receive item 16. As can be seen in FIG. 6, when the two body members are united at their respective flat surfaces, they form the body portion of my device. Opposite item 10 is a like semi-circular recess 10' of lower body member 4'. Together they form the bearing surfaces in which the spool 20 is rotatably mounted.

The spool preferably has four flanges on each side to retain the string. A crank 22 is secured at one end of the spool where it protrudes from the body portion and a handle is at the opposite end for manually winding the string.

Figure 4:
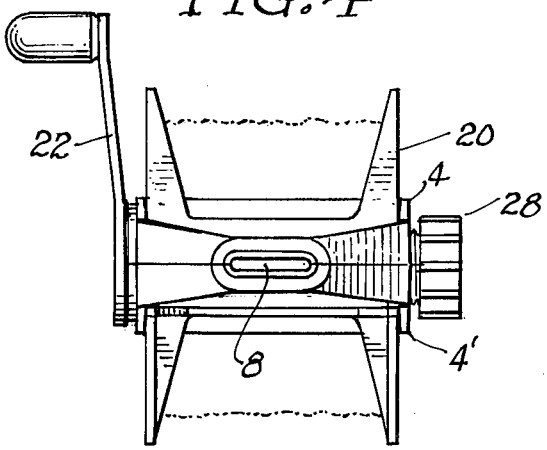
FIG. 4 is an end view thereof taken from the kite.
Figure 5:
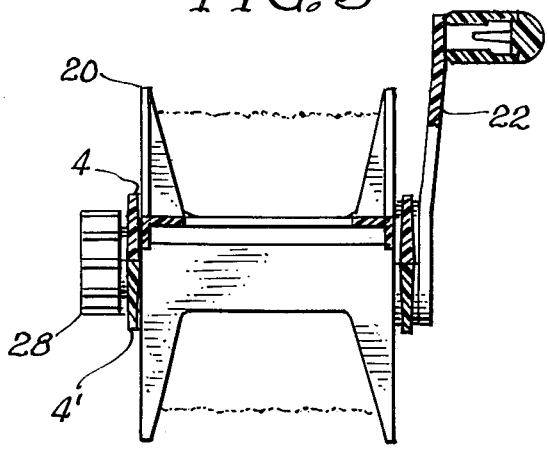
FIG. 5 is an end view of the moving parts of the assembly taken along line 5—5 of FIG. 2.

The lower body member also has a rectangular aperture to match that of the upper member. Together they form a line guide aperture with space for the operator to move the device from side to side for uniform placement of string on the spool. See FIG. 4.

Figure 3:
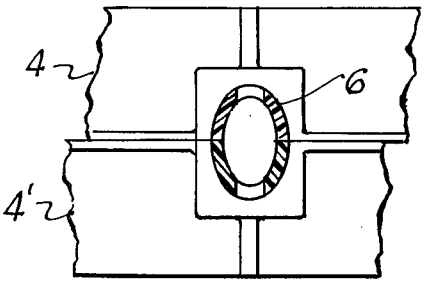
FIG. 3 is a cross sectional detail of the handle taken along line 3—3 of FIG. 2.
Figure 2:
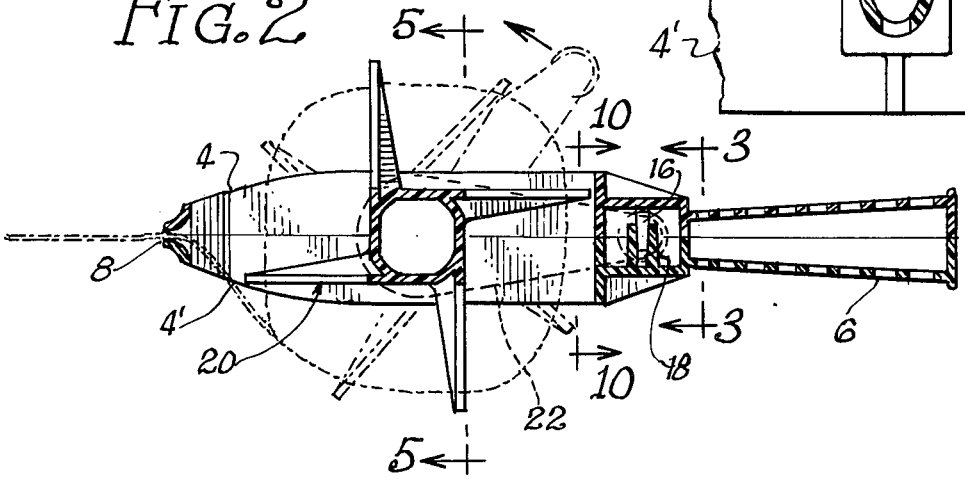
FIG. 2 is a side elevation thereof showing, by dotted lines and arrow, the line, spool and crank action.

At the opposite end of the lower body member is also an semi-elipsoid shaped member with orifices that align with those of item 6. Together they unite to form a handle with oval cross section as in FIG. 3.

I claim:

1. In a reel assembly the combination of:

a. dual oppositely disposed body members that are united to form a frame for the assembly;

b. a spool rotatably mounted within the body members upon which spool string may be wound, each end of said spool within said body members having four flanges formed thereon for retaining said string therebetween, one of said ends having an axial, outwardly-directed extension which has a cylindrical outer surface and an outwardly tapered inner surface;

c. a crank with handle for rotating the spool integrally formed on the end of the spool opposite the end having said extension; and d. frictional brake means and means on said frame for mounting said brake means for turning movement, said brake means having a tapered surface which cooperates with the tapered surface on said extension when said brake means is turned on its mounting on said frame to wedge said extension against said frame to control the resistance to force applied to the string on the spool.

2. A reel assembly for storage of kite lines and the like comprising in combination: a line storage spool assembly having at each end four flanges formed integrally thereon to retain the line on the spool, one end of said spool having a crank with handle formed thereon, the opposite end of said spool having an axial, outwardly-directed extension which has a cylindrical outer surface and an outwardly tapered inner surface; a pair of oppositely disposed body members which are secured together to form the body portion of said assembly, each of said body members having semi-circular recesses which form bearing surfaces for said spool to be rotatably mounted, each of the body members having on one and the same side a semi-circular, thread-bearing nipple extending outwardly and receiving said axial extension when said body members are assembled about said spool; and a knurled knob threadedly engaging said threaded nipple and having an inwardly extending tapered member to engage the inner, tapered surface of said axial extension when said knob is manually turned to wedge the said extension between said nipple and the tapered member of said knob to control the rotation of the spool assembly.

3. The reel assembly according to claim 2 wherein each of said body members has a rectangular aperture at one end and a semi-elipsoid extension at the opposite end to form a line guide at said one end and a handle at said opposite end when said body mebers are secured together to form said body portion.

* * * * *

UNITED STATES PATENT AND TRADEMARK OFFICE

CERTIFICATE OF CORRECTION

PATENT NO. : 4,106,719

DATED : August 15, 1978

INVENTOR(S) : Joseph G. Haverland

It is certified that error appears in the above-identified patent and that said Letters Patent are hereby corrected as shown below:

Column 2, after line 27 add the language as shown on the attached sheets.

As a final important feature, I have provided an axial extension 26 of the spool at its end opposite the crank end. It's tubular inside walls taper outward or flange-like. It fits snugly in a threaded nipple 24, one half being integral with member 4 and the other one half being integral with member 4'.

Novel cap 30 is preferably circular with knurls for manual operation. It has threads around its interior surface for engagement with the exterior threads of item 26. It has a tubular protrusion centrally and inwardly disposed with walls that taper to form a cone section with its smallest diameter farthest from the outside of the cap. Such construction permits a turning or tightening of the cap to cause a wedging action on the spool extension since it is sandwiched between the body portion nipple and the cone section of the cap.

UNITED STATES PATENT AND TRADEMARK OFFICE

CERTIFICATE OF CORRECTION

PATENT NO. : 4,106,719

DATED : August 15, 1978

INVENTOR(S) : Joseph G. Haverland

It is certified that error appears in the above-identified patent and that said Letters Patent are hereby corrected as shown below:

The amount of friction can be controlled by turning the knob and the drag on the kite string can thereby be varied at will.

Signed and Sealed this

*Twenty-ninth* Day of *January 1980*

[SEAL]

*Attest:*

SIDNEY A. DIAMOND

*Attesting Officer* *Commissioner of Patents and Trademarks*